US011684133B2

(12) United States Patent
Fan et al.

(10) Patent No.: US 11,684,133 B2
(45) Date of Patent: Jun. 27, 2023

(54) DEPILATORY WAX APPLYING DEVICE

(71) Applicant: Guangzhou Dexin New Material Technology Co., Ltd, Guangdong (CN)

(72) Inventors: Zhiyong Fan, Guangzhou (CN); Dexian Fan, Guangzhou (CN)

(73) Assignee: GUANGDONG DEXIN NEW MATERIAL TECHNOLOGY CO., LTD, Guangdong (CN)

( * ) Notice: Subject to any disclaimer, the term of this patent is extended or adjusted under 35 U.S.C. 154(b) by 88 days.

(21) Appl. No.: 17/187,302

(22) Filed: Feb. 26, 2021

(65) Prior Publication Data

US 2021/0298447 A1 Sep. 30, 2021

(30) Foreign Application Priority Data

Mar. 25, 2020 (CN) ..... 202010219157.9
Mar. 31, 2020 (CN) ..... 202010244918.6

(51) Int. Cl.
*A45D 26/00* (2006.01)

(52) U.S. Cl.
CPC .... *A45D 26/0014* (2013.01); *A45D 2026/008* (2013.01); *A45D 2200/155* (2013.01)

(58) Field of Classification Search
CPC ..... A45D 26/0014; A45D 2200/155; A45D 2026/008; A45D 2200/20; A45D 2200/15; A45D 2200/152; A45D 2024/0095
USPC ..... 401/1, 2
See application file for complete search history.

(56) References Cited

U.S. PATENT DOCUMENTS 4,553,935 A * 11/1985 Ueno ..... A61C 13/0028 433/32
6,558,059 B1 * 5/2003 Hillinger ..... B05C 17/00536 401/2
11,109,668 B2 * 9/2021 Goldfarb ..... A45D 26/0014

* cited by examiner

*Primary Examiner* — David J Walczak
(74) *Attorney, Agent, or Firm* — Hamre, Schumann, Mueller & Larson, P.C.

(57) ABSTRACT

A depilatory wax applying device includes: a housing provided with a feed port and a discharge port; a conveying channel provided in the housing, the conveying channel including a guiding tube, a heat insulation tube, and a heating tube that are connected successively, the guiding tube corresponding to the feed port, and the heating tube corresponding to the discharge port; a wax strip pushing device provided between the feed port and the guiding tube and configured to push a wax strip into the guiding tube; and a control device provided in the housing and electrically connected to the heating tube and the wax strip pushing device.

17 Claims, 12 Drawing Sheets

DEPILATORY WAX APPLYING DEVICE

CROSS REFERENCE TO RELATED APPLICATIONS

This application claims priority to Chinese Patent Applications No. 2020102191579, filed on Mar. 25, 2020, entitled "WAX STRIP PUSHING DEVICE", and No. 2020102449186, filed on Mar. 31, 2020, entitled "HAND-HELD DEPILATORY WAX APPLYING DEVICE", and the entire content of which are incorporated herein in their entirety.

TECHNICAL FIELD

The present disclosure relates to a human hair removal device, and in particular, to a depilatory wax applying device.

BACKGROUND

Methods of human hair removal mainly include physical hair removal, chemical hair removal and photoelectric hair removal. The physical hair removal is to remove the hair by external force, which mainly includes mechanical hair removal and wax hair removal.

Components of a depilatory wax are wax (various animal, plant, mineral or synthetic wax), tackifying resin and polymer materials. The depilatory wax is in a solid state at room temperature, and needs to be heated to melt before use. The wax is applied to the skin that needs to hair removal. When the wax and the hair on the skin are cooled and solidified into one, the wax and the hair are quickly torn off together to achieve the purpose of hair removal. The advantages of the depilatory wax are that the hair removal is completely, painless, and has no residue, and thus no cleaning or depilatory paper is needed. However, the depilatory wax hair removal has many disadvantages as follows. Firstly, a special electric heating wax melting device is required, and is generally powered by a power supply of 220V or 110V, which is relatively large and inconvenient to carry. Secondly, wax applying tools, such as tongue depressors, wax applying knives and other disposable tools, are required to be used, which are relatively expensive. Thirdly, technical requirements for operators are relatively high, and the depilatory wax hair removal need to be operated by professional beauticians in beauty salons, which is difficult to be used at home like a toothbrush.

SUMMARY

According to various embodiments, a depilatory wax applying device is provided.

A depilatory wax applying device includes: a housing provided with a feed port and a discharge port; a conveying channel provided in the housing, the conveying channel including a guiding tube, a heat insulation tube, and a heating tube that are connected successively, the guiding tube corresponding to the feed port, and the heating tube corresponding to the discharge port; a wax strip pushing device provided between the feed port and the guiding tube and configured to push a wax strip into the guiding tube; and a control device provided in the housing and electrically connected to the heating tube and the wax strip pushing device.

The conveying channel of the depilatory wax applying device includes the heating tube, the heat insulation tube, and the guiding tube, due to the presence of the wax strip pushing device, the wax strip can smoothly pass through the conveying channel and be melted, which makes the process of applying the depilatory wax more convenient, making the hair removal with the depilatory wax a simple skill at home, without paying high care costs in beauty salons.

The details of one or more embodiments of the application are set forth in the following drawings and description. Other features, objects and advantages of the application will become apparent from the description, drawings, and claims.

BRIEF DESCRIPTION OF THE DRAWINGS

To illustrate the technical solutions according to the embodiments of the present disclosure or prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

In order to facilitate the understanding of the present disclosure, the present disclosure will be described more fully with reference to the relevant drawings. Preferred embodiments of the present disclosure are shown in the attached drawings. However, the present disclosure can be implemented in many different forms and is not limited to the embodiments described herein. On the contrary, providing these embodiments is to make the disclosure of the present disclosure more thorough and comprehensive.

It should be noted that when an element is referred to as being "fixed to" another element, it can be directly on another element or there may be an intermediate element therebetween. When an element is considered to be "connected to" another element, it can be directly connected to another element or there may be an intermediate element at the same time. Terms "vertical", "horizontal", "left", "right" and similar expressions used herein are for illustrative purposes only.

Unless otherwise defined, all technological and scientific terms used herein have the same meaning as commonly understood by those skilled in the technical field to which the present disclosure belongs. The terms used in the specification of the present disclosure herein are only for the purpose of describing specific embodiments, and are not intended to limit the present disclosure. The term "and/or" as used herein includes any and all combinations of one or more associated listed items.

Figure 1:
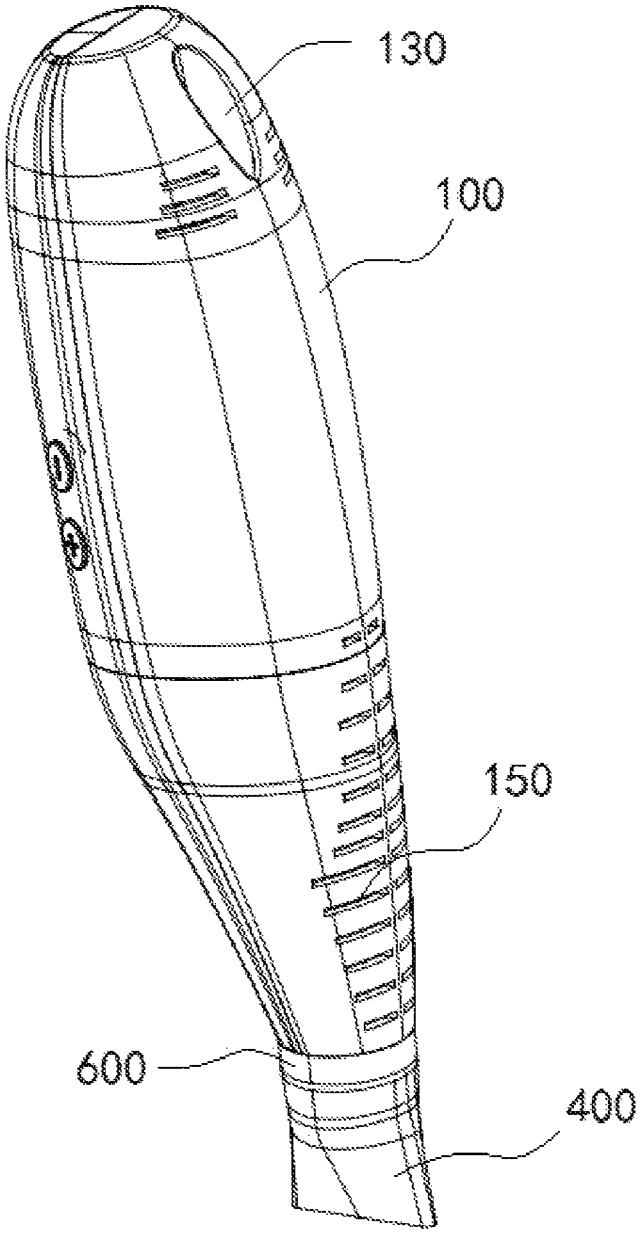
FIG. 1 is a perspective view of a depilatory wax applying device according to an embodiment.
Figure 2:
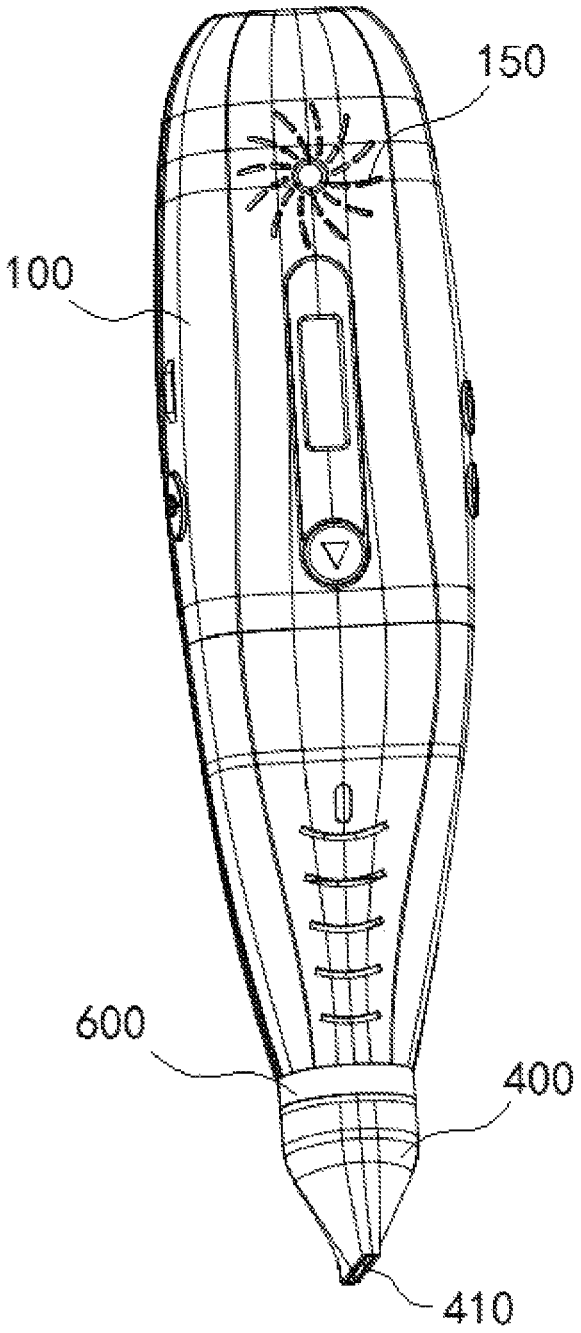
FIG. 2 is a perspective view of the depilatory wax applying device shown in FIG. 1, viewed from another aspect.
Figure 3:
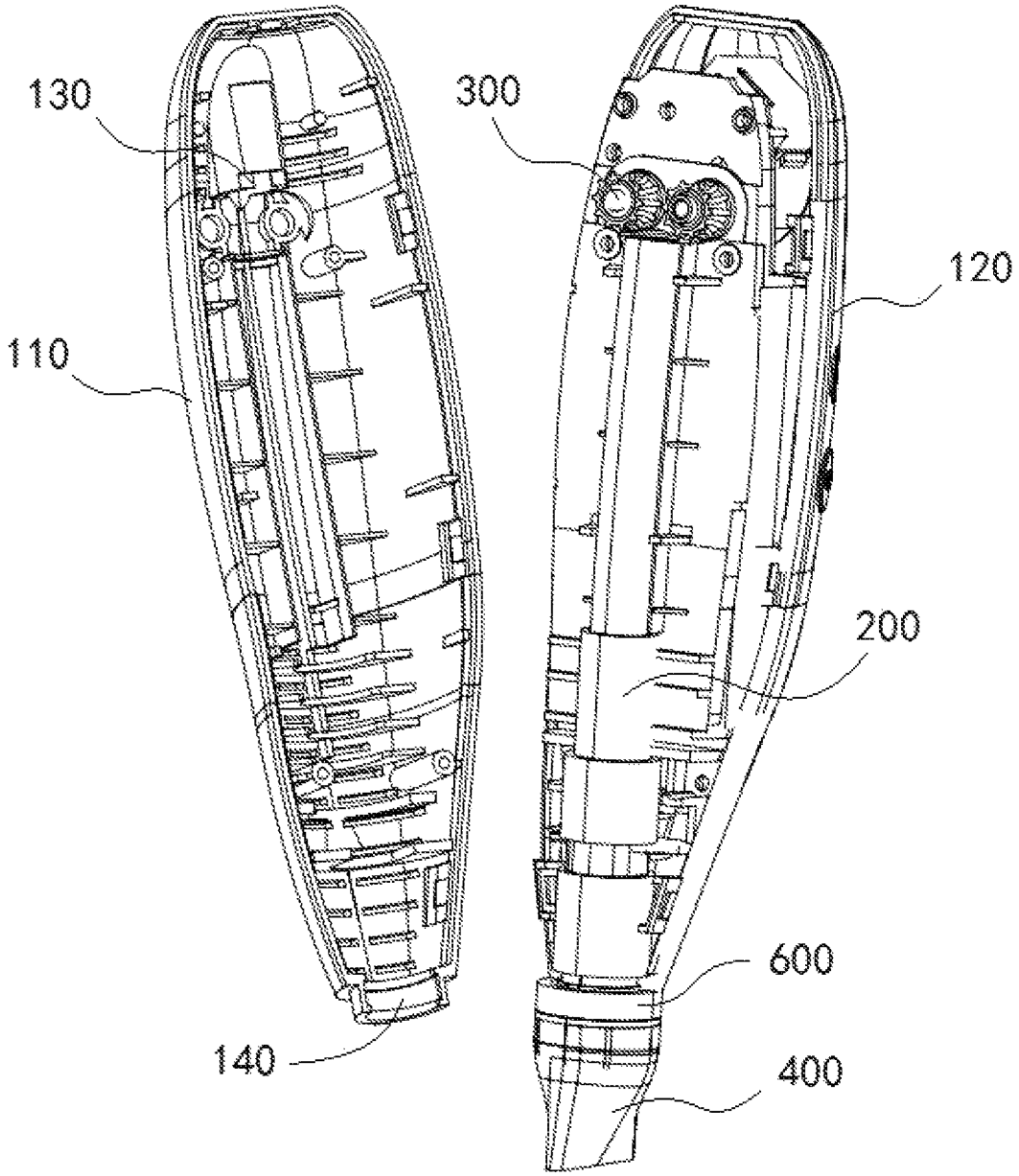
FIG. 3 is a perspective exploded view of the depilatory wax applying device shown in FIG. 1.

Referring to FIGS. 1 to 3, a depilatory wax applying device according to an embodiment includes a housing 100. The housing 100 is provided with a feed port 130 at a top thereof and a discharge port 140 at a bottom thereof.

Figure 4:
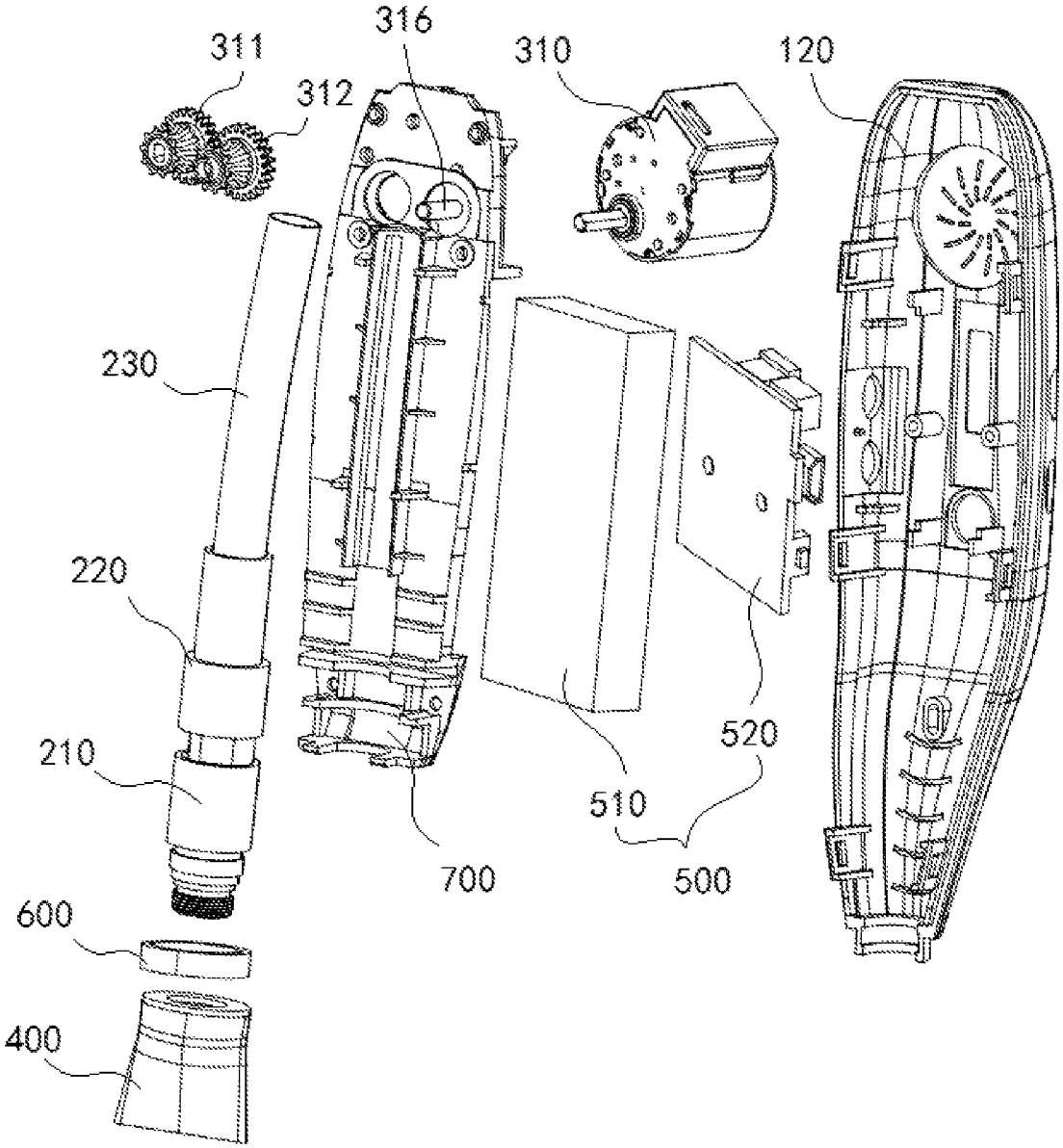
FIG. 4 is a perspective exploded view of the depilatory wax applying device shown in FIG. 3.
Figure 8:
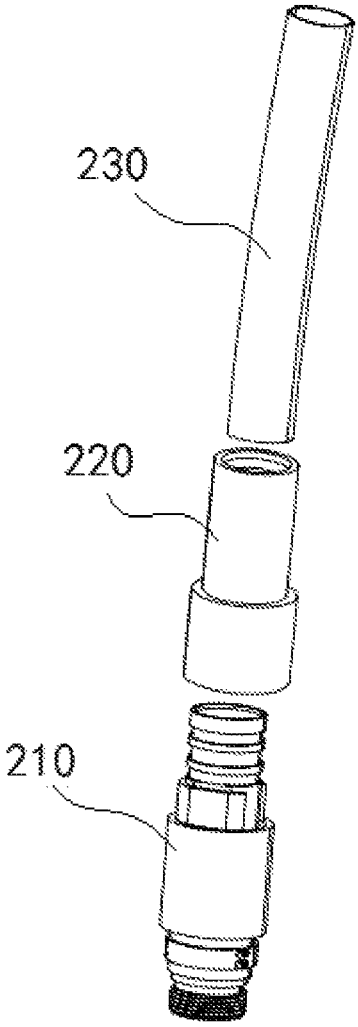
FIG. 8 is a perspective exploded view of a conveying channel shown in FIG. 4.

Referring to FIG. 3, in one embodiment, in order to facilitate installation, the housing 100 may be formed by combining a first housing 110 and a second housing 120. The housing 100 is provided with a conveying channel 200. One end of the conveying channel 200 corresponds to the feed port 130, and the other end of the conveying channel 200 corresponds to the discharge port 140. Referring to FIGS. 4 and 8, the conveying channel 200 includes a heating tube 210, a heat insulation tube 220, and a guiding tube 230 that are connected successively. The guiding tube 230 corresponds to the feed port 130, and the heating tube 210 corresponds to the discharge port 140. A wax strip pushing device 300 for pushing a wax strip 00 (strips of solid depilatory wax) is provided between the feed port 130 and the guiding tube 230. A control device 500 is further provided in the housing 100 and is electrically connected to the heating tube 210 and the wax strip pushing device 300.

Specifically, referring to FIG. 3, there is a gap between the feed port 130 and the guiding tube 230. The wax strip pushing device 300 is located in the gap, such that the wax strip 00 fed from the feed port 130 can automatically enter the guiding tube 230. After the wax strip 00 is inserted into the feed port 130, the wax strip 00 is driven by the wax strip pushing device 300 into the guiding tube 230, and then enters the heating tube 210. The heating tube 210 transfers heat to the wax strip 00 to melt the wax strip 00. Finally, the wax strip 00 is discharged from the discharge port 140.

The conveying channel 200 includes the heating tube 210, the heat insulation tube 220, and the guiding tube 230, such that the wax strip 00 can smoothly pass through the conveying channel 200 and be melted, and the melted depilatory wax is prevented from polluting an inside of the housing 100. Referring to FIG. 8, to ensure the wax strip 00 can reach the heating tube 210 and be melted smoothly, the guiding tube 230 needs to play a guiding role to prevent the wax strip 00 from getting jammed inside the housing 100. The guiding tube 230 made of PVC can have a smooth inner sidewall, which enables the wax strip 00 to move more smoothly. In order to melt the wax strip 00, a temperature of the heating tube 210 can be in a range of 70° C. to 100° C. The heat insulation tube 220 is provided between the guiding tube 230 and the heating tube 210 to prevent the guiding tube 230 from being heated by the heating tube 210 to cause deformation. The heat insulation tube 220 is made of materials with good heat resistance and low thermal conductivity, such as silicone.

As such, the depilatory wax applying device of this embodiment can melt and squeeze the wax strip 00. It is only necessary to hold the depilatory wax applying device to complete the applying of the depilatory wax, and thus the applying process is more convenient and quick, without preparing other heating tools and applying tools, which reduces the preparing work before applying, and which is particularly obvious for improving the efficiency of a beauty shop. Therefore, to a certain extent, consumers' desire to buy solid depilatory wax can be increased, and thus the sales of the solid depilatory wax can be increased.

In some embodiments, in order to omit the operation of flatting the depilatory wax on the skin when applying the depilatory wax, referring to FIGS. 3 and 4, the depilatory wax applying device further includes a wax applying head 400 provided at the discharge port 140. The wax applying head 400 has a flat discharge hole 410 (see FIG. 2) at a bottom thereof. One end of the heating tube 210 extends out of the discharge port 140, and then is connected to the wax applying head 400. The wax strip 00 is melted in the heating tube 210, and then flows out from the flat discharge hole 410 of the wax applying head 400. The melted depilatory wax is automatically flattened and can be directly applied to the skin without second flattening, thereby speeding up the applying of the depilatory wax.

Since the melted depilatory wax tends to solidify at room temperature, in order to prevent the melted depilatory wax from solidifying in the wax applying head 400 and blocking the discharge hole 410, the wax applying head 400 is made of metal, and the wax applying head 400 is covered with a silicone layer. The heat of the heating tube 210 can be transferred to the inside of the wax applying head 400 to keep the melted depilatory wax at a certain temperature to avoid solidification. In this case, the silicone layer outside the wax applying head 400 can insulate the heat to avoid burning the user when applying the depilatory wax. In addition, in order to adapt to various types of depilatory wax, different sizes of discharge holes 410 may be provided, and thus the wax applying head 400 and the heating tube 210 are connected in a threaded manner to facilitate the replacement of different types and sizes of wax applying heads 400.

Further, in order to prevent the melted depilatory wax from overflowing a space between the wax applying head 400 and the housing 100, a sealing ring 600 is provided between the wax applying head 400 and the housing 100. The sealing ring 600 can be made of fluorine rubber, which has high temperature resistance and good sealing effect.

Figure 5:
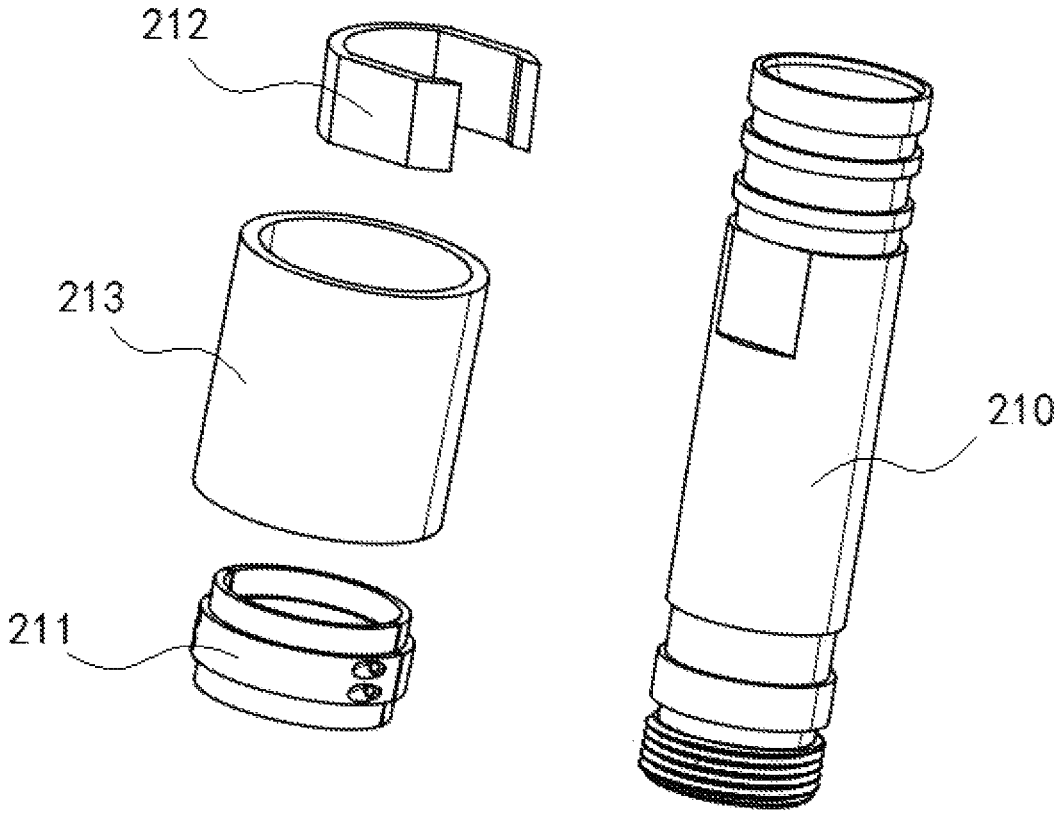
FIG. 5 is a perspective exploded view of a heating tube shown in FIG. 4.
Figure 6:
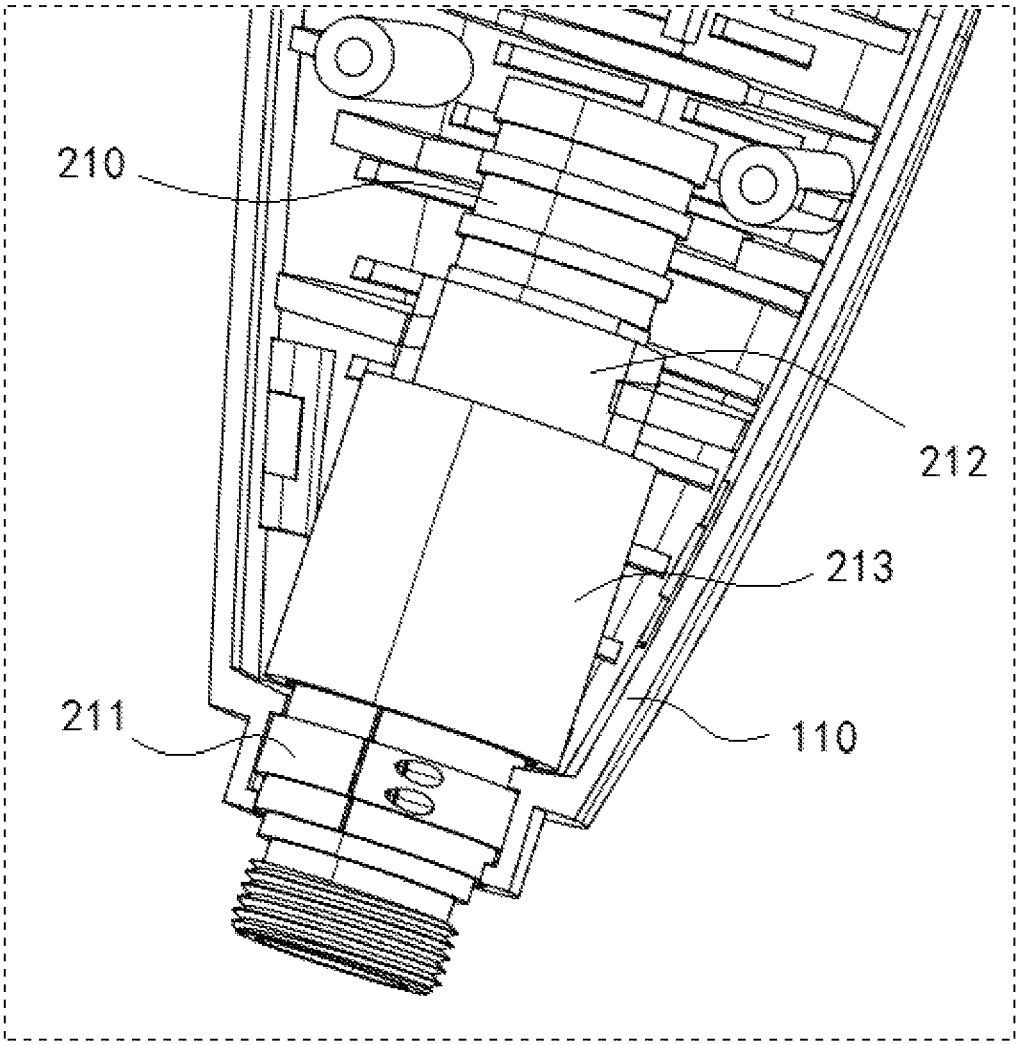
FIG. 6 is a partial enlarged view of the depilatory wax applying device shown in FIG. 3, where a wax applying head is omitted.

In some embodiments, in order to well fix the conveying channel 200, referring to FIGS. 5 and 6, the heating tube 210 is provided with a first engaging member 211 and a second engaging member 212. A diameter of the first engaging member 211 is greater than that of the heating tube 210. The housing 100 is provided with an engaging groove (not labeled) matching the first engaging member 211 to prevent the heating tube 210 from moving. In addition, the housing 100 is provided with a plurality of reinforcing ribs (not labeled). The reinforcing ribs form an engaging portion that matches a shape of the second engaging member 212 to prevent the heating tube 210 from rotating. It can be understood that the first engaging member 211 and the second engaging member 212 may be parts independent of the heating tube 210 or a part of the heating tube 210. In that case, even if the housing 100 is made of a material that is not resistant to a high temperature, as long as the first engaging member 211 and the second engaging member 212 are made of high temperature resistant and low thermal conductivity materials, the heat of the heating tube 210 will not be transferred onto the housing 100.

The heat function of the heating tube 210 can be implemented by an external heating wire. In some embodiments, a heating wire, a resistance wire, and the like can be tightly sleeved outside the heating tube 210 by a fastening sleeve 213. The fastening sleeve 213 is made of rubber material with good heat resistance, low thermal conductivity, and elasticity, and can wrap the heating wire to prevent loosening. It can be understood that if the heating tube 210 itself is made of a heat-generating material, the fastening sleeve 213 can also be omitted.

Figure 7:
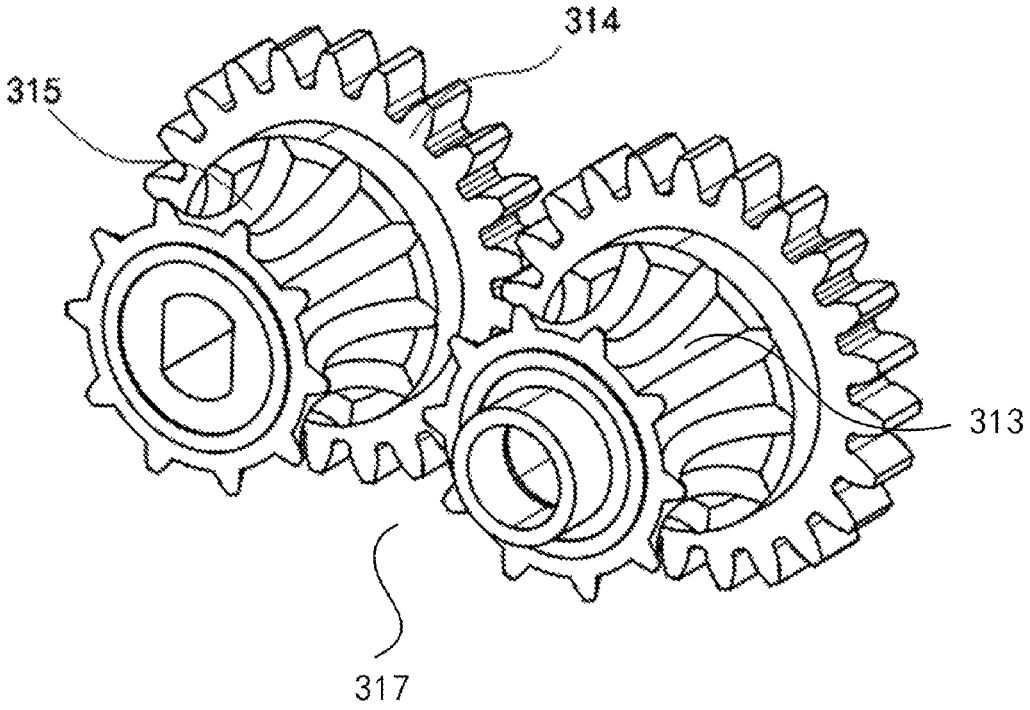
FIG. 7 is an enlarged perspective view of a driving wheel and a driven wheel shown in FIG. 4.

Referring to FIGS. 4 and 7, a first embodiment of the wax strip pushing device 300 is provided. The wax strip pushing device 300 includes an electric motor 310, a driving wheel 311 driven by the electric motor 310, and a driven wheel 312 driven by the driving wheel 311. The driving wheel 311 and the driven wheel 312 are provided side by side, and an axis of the driving wheel 311 is parallel to an axis of the driven wheel 312. The driving wheel 311 and the driven wheel 312 each includes a wheel body. An outer gear ring 314 is provided at an end of the wheel body. The outer gear ring 314 on the driving wheel 311 is engaged with the outer gear ring 314 on the driven wheel 312. Referring to FIGS. 3 and 4, the wheel body of the driving wheel 311 can be fixed on an output shaft of the electric motor 310, and the wheel body of the driven wheel 312 is sleeved on a support shaft 316. The support shaft 316 is fixed in the housing 100, thereby avoiding the translation of the driving wheel 311 and the driven wheel 312 during rotation. The wheel body of the driving wheel 311 and the wheel body of the driven wheel 312 are each provided with an arc-shaped recess 313 along a circumferential direction thereof. A channel 317 allowing the wax strip 00 to pass through is formed between the two recesses 313. The wax strip 00 usually has a shape of cylinder, and a size of the channel 317 is slightly smaller than a diameter of the wax strip 00. Therefore, the driving wheel 311 and the driven wheel 312 can squeeze the wax strip 00 from its both sides, and the rotation of the driving wheel 311 and the driven wheel 312 can drive the wax strip 00 to move linearly.

Specifically, an outer surface of each recess 313 is provided with a plurality of convex ribs 315 along the circumferential direction. The convex rib 315 may be, for example, an arc-shaped strip that fits an outer surface of the wax strip 00. The convex ribs 315 can be inserted into the surface of the wax strip 00, such that the driving wheel 311 and the driven wheel 312 can clamp the wax strip 00, enabling the wax strip 00 to be pushed into the guiding tube 230 more smoothly. In some embodiments, at least three convex ribs 315 are provided. Through the channel 317 formed between the driving wheel 311 and the driven wheel 312, the wax strip 00 can be positioned. On the one hand, the wax strip 00 can enter the guiding tube 230 smoothly after entering from the feed port 130, and on the other hand, a slipping between the convex rib 315 and the wax strip 00 can be effectively avoided.

Figure 10:
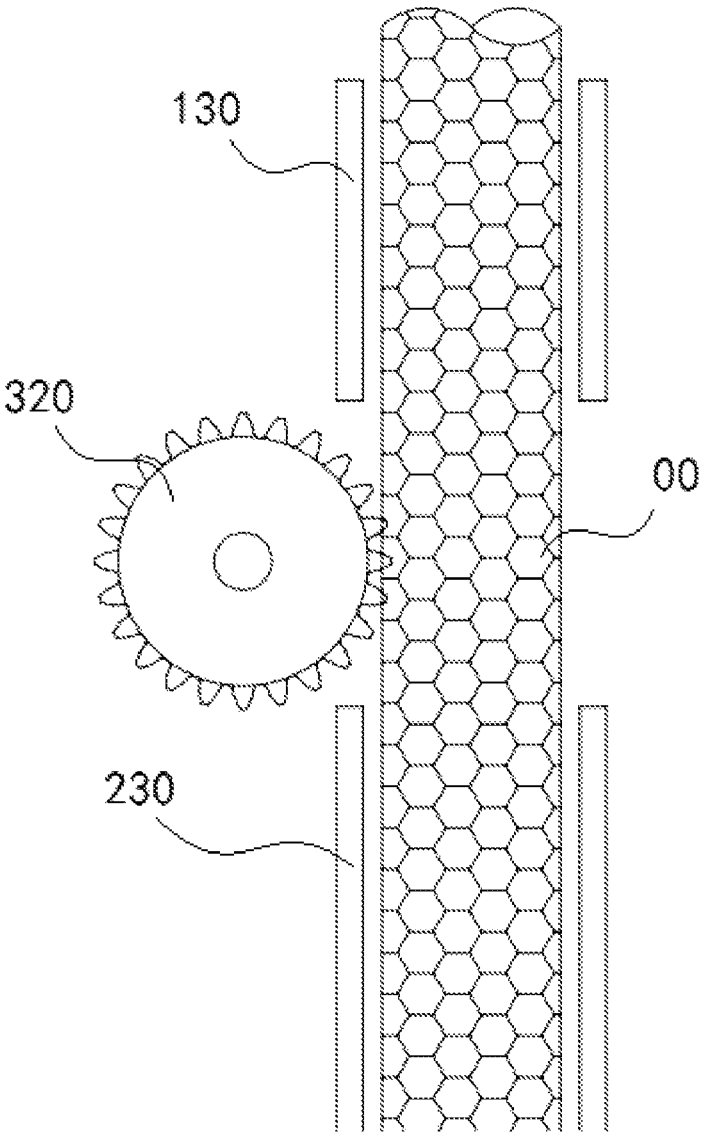
FIG. 10 is a schematic view of a wax strip pushing device according to another embodiment.

Referring to FIG. 10, a wax strip pushing device 300 of a second embodiment includes an electric motor 310 and a first toggle gear 320. The first toggle gear 320 may have a structure of a conventional gear. The first toggle gear 320 is provided between the feed port 130 and the guiding tube 230, and is located on one side of the wax strip 00. The electric motor 310 can drive the first toggle gear 320 to rotate. When the first toggle gear 320 rotates, teeth of the first toggle gear 320 will be inserted into the wax strip 00 and drive the wax strip 00 to move toward the guiding tube 230, in this way, the pushing of the wax strip 00 can also be achieved.

Figure 11:
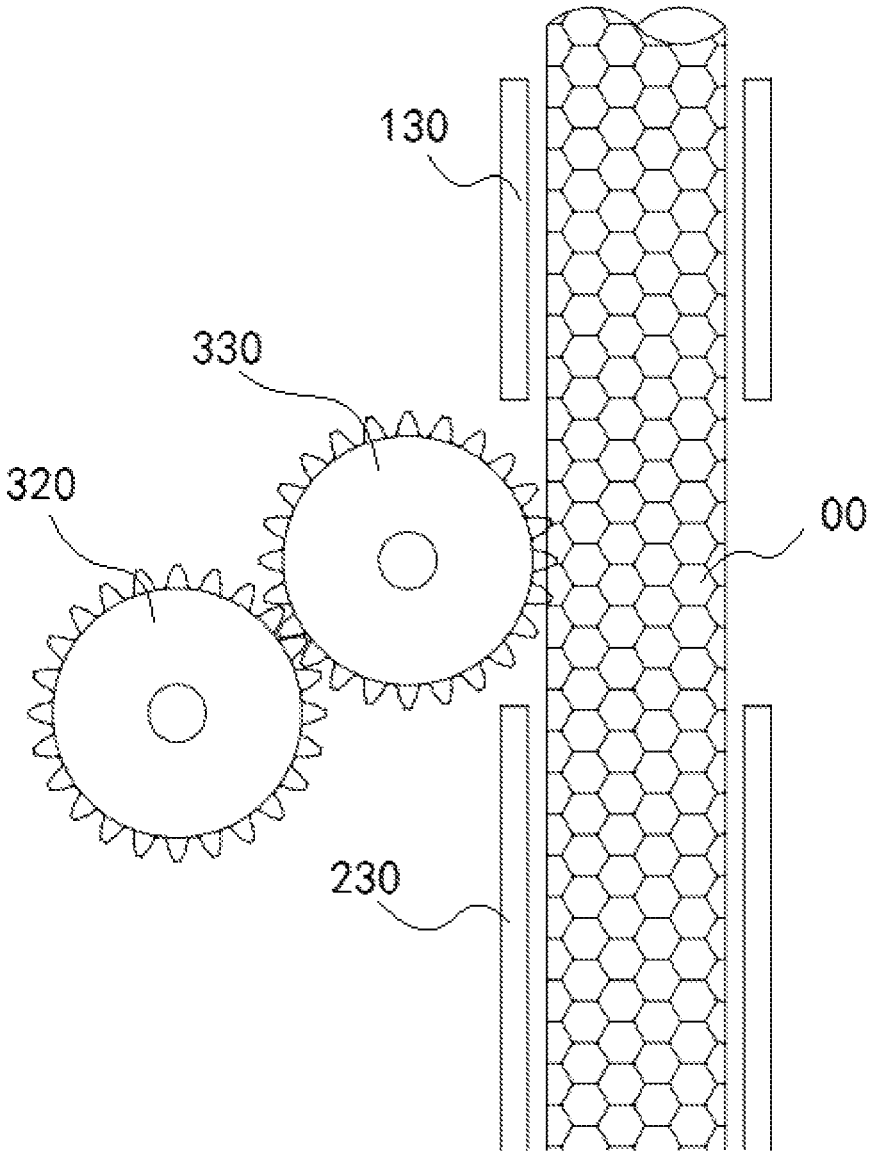
FIG. 11 is a schematic view of a wax strip pushing device according to yet another embodiment.

According to the wax strip pushing device 300 of the second embodiment shown in FIG. 10, since the teeth of the first toggle gear 320 are inserted into the wax strip 00 and drive the wax strip 00 to move, after a period of use, gaps between the teeth may be filled with the depilatory wax, which will cause a slipping between the first toggle gear 320 and the wax strip 00, and thus the wax strip pushing device 300 cannot work. To solve this problem, referring to FIG. 11, a wax strip pushing device 300 of a third embodiment includes an electric motor 310, a first toggle gear 320, and a second toggle gear 330. The second toggle gear 330 is provided at one side of the wax strip 00 and drives the wax strip 00 to move. The first toggle gear 320 is engaged with the second toggle gear 330. The electric motor 310 can directly drive the first toggle gear 320 or the second toggle gear 330 to rotate. In this way, when gaps between teeth of the second toggle gear 330 are filled with the depilatory wax, teeth of the first toggle gear 320 can dig out the depilatory wax filled in the gaps between the teeth of the second toggle gear 330 to avoid the slipping between the second toggle gear 330 and the wax strip 00. The first toggle gear 320 and the second toggle gear 330 can also be positioned by a structure in the housing 100 to prevent the first toggle gear 320 and the second toggle gear 330 from moving during rotation.

Figure 12:
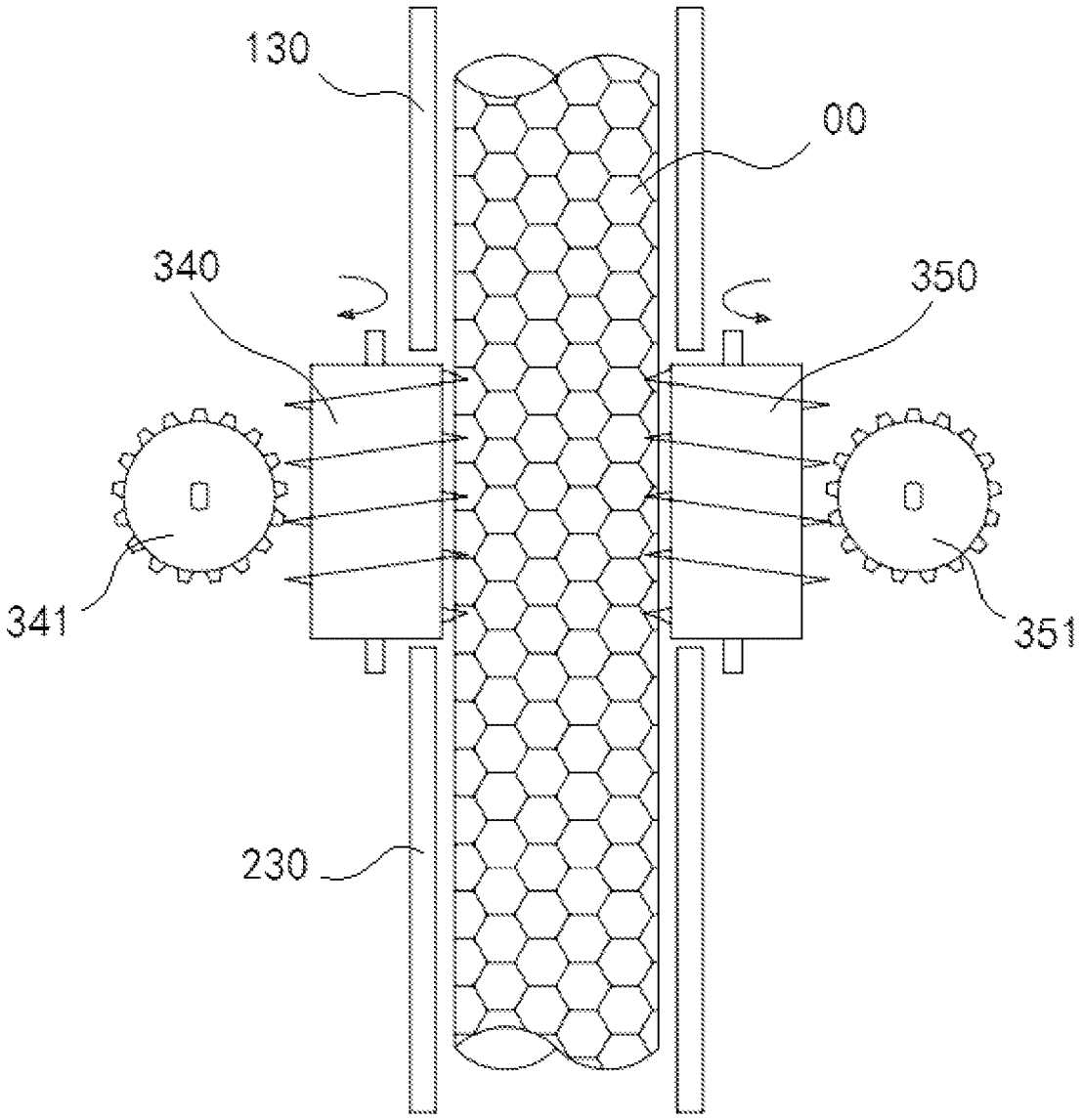
FIG. 12 is a schematic view of a wax strip pushing device according to yet another embodiment.

Referring to FIG. 12, a wax strip pushing device 300 of a fourth embodiment includes a first electric motor (not shown), a second electric motor (not shown), a first worm 340, and a second worm 350. The first electric motor can drive the first worm 340 to rotate, and the second electric motor can drive the second worm 350 to rotate. The first worm 340, the second worm 350, and the wax strip 00 are provided side by side, and an axis of the first worm 340 and an axis of the second worm 350 are parallel to an axis of the wax strip 00. The wax strip 00 is clamped between the first worm 340 and the second worm 350. Rotation directions of the first worm 340 and the second worm 350 are opposite. In this way, when the first worm 340 and the second worm 350 rotate, teeth of the first worm 340 and teeth of the second worm 350 are inserted into the outer surface of the wax strip 00. Since the teeth of the first worm 340 and the teeth of the second worm 350 are helical teeth, a force of the first worm 340 or the second worm 350 on the wax strip 00 can be decomposed into a force on the wax strip 00 in a circumferential direction and a force on the wax strip 00 in a radial direction. Since the rotation directions of the first worm 340 and the second worm 350 are opposite, the forces on the wax strip 00 in the circumferential direction cancel each other, and the remaining force on the wax strip 00 in the radial direction will drive the wax strip 00 to move toward the guiding tube 230. In addition, the wax strip pushing device 300 further includes a first worm gear 341 engaged with the first worm 340, and a second worm gear 351 engaged with the second worm 350. The first worm 340 and the second worm 350 may be mounted inside the housing 100. Since when rotating, the teeth of the first worm 340 and the second worm 350 do not drive the wax strip 00 by scraping, there will be no situation where the depilatory wax fills gaps between the teeth, which reduces the chance of slipping, effectively improving the service life of the wax strip pushing device 300.

Figure 9:
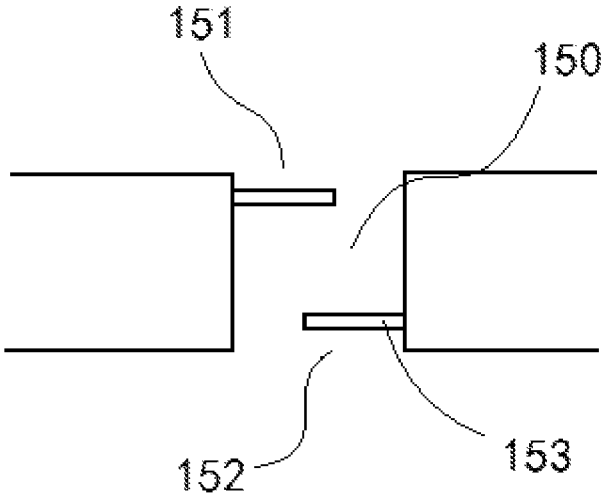
FIG. 9 is a schematic view of a heat dissipation hole.

In some embodiments, referring to FIGS. 1 and 2, a plurality of heat dissipation holes 150 are provided on the housing 100. In order to facilitate the heat dissipation of the electric motor 310 and the heating tube 210, the heat dissipation holes 150 are particularly gathered on the positions on the housing 100 corresponding to the electric motor 310 and the heating tube 210. In addition, in order to avoid an internal structure of the housing 100 from being viewed from the outside through the heat dissipation hole 150, referring to FIG. 9, one end of the heat dissipation hole 150 forms a first hole 151 located at an outer surface of the housing 100, and the other end of the heat dissipation hole 150 forms a second hole 152 located at an inner surface of the housing 100. A plurality of baffles 153 for blocking light are provided in the heat dissipation hole 150. The baffles 153 form a non-linear air passage between the first hole 151 and the second hole 152, such that the heat dissipation hole 150 is permeable to air but not light, thereby enhancing aesthetics.

In some embodiments, referring to FIGS. 3 and 4, in order to make the structure inside the housing 100 arranged more reasonable, a partition plate 700 can be provided inside the housing 100. The partition plate 700 can separate the conveying channel 200 from the control device 500. Moreover, the partition plate 700 is provided with conventional structures such as reinforcing ribs and mounting holes, which can adapt to shapes of various components and facilitate the positioning of the components. For example, the reinforcing ribs on the partition plate 700 can form an engaging portion (not labeled) that matches the second engaging member 212, or can form a limiting groove (not labeled) that is convenient for limiting the guiding tube 230.

It should be noted that the depilatory wax is very sticky even when melted, therefore, the depilatory wax can only be squeezed out when the wax strip pushing device 300 squeezes and pushes the unmelted wax strip 00. When the wax strip pushing device 300 does not push the wax strip 00, the depilatory wax will not be squeezed out. In order to prevent the depilatory wax from flowing upward along the conveying channel 200, the gap between the wax strip 00 and the conveying channel 200 should not be too large. For example, the gap may be within 2.5 mm.

In some embodiments, referring to FIG. 4, the control device 500 includes a circuit board 520 and a battery 510. The heating tube 210 and the wax strip pushing device 300 are electrically connected to the circuit board 520, respectively. In order to facilitate the control of the depilatory wax applying device, as shown in FIG. 2, function keys such as a temperature decrease key, a temperature increase key, an LED display screen, a switch, a feed key, and a universal serial bus (USB) interface can be provided on the surface of the housing 100. The USB interface is connected to the battery 510, and thus the battery 510 can be charged through the USB interface. The temperature decrease key, the temperature increase key, the light-emitting diode (LED) display screen, the switch and the feed key are all electrically connected to the circuit board 520. The temperature decrease key and the temperature increase key can control a heating temperature of the heating tube 210. The feed key is used to adjust a pushing speed of the wax strip pushing device 300 by different gear positions. The higher the gear position is, the faster a feeding speed is. For example, when the feed key is pressed one time, the wax strip pushing device 300 pushes the wax strip 00 at a first gear speed. When the feed key is pressed two times, the wax strip pushing device 300 pushes the wax strip 00 at a second gear speed. When the feed key is pressed three times, the wax strip pushing device 300 pushes the wax strip 00 at a third gear speed. When the feed key is pressed four times, the wax strip pushing device 300 is reset to push the wax strip 00 at the first gear speed, which is adjusted cyclically as such. The LED display screen can be used to display the remaining capacity of the battery 510, the heating temperature of the heating tube 210, a current gear position of the wax strip pushing device 300, and the like. The switch is used to turn on/off the depilatory wax applying device.

Specifically, in practical applications, different hair removal techniques may be required for the body hair on different parts. For example, when trimming eyebrows, since the eyebrows are thick and not easy to tear off, precise hair removal is required, and the eyebrows required to be retained should be avoided being removed, a higher concentration of depilatory wax is required. In addition, it is also necessary to ensure that the depilatory wax does not spread randomly during applying, while the depilatory wax is applied accurately, therefore, the wax applying head 400 with the smaller discharge hole 410 is required. For another example, when the hair on the arm needs to be removed, the hair is thin and easy to tear off, and thus, a slightly lower concentration of depilatory wax is required. Moreover, the depilatory wax is required to settle to the root of the hair after being applied, such that the depilatory wax can be tightly adhered to most of the hair, so as to prevent the hair from being torn off when the depilatory wax is torn off and thus prevent that the hair removal is not completely. In addition, in order to improve the efficiency of hair removal, the wax applying head 400 with the larger discharge hole 410 is required to speed up the applying speed. In the above cases, the higher the concentration of the depilatory wax is, a higher melting temperature requires, and thus it is necessary to control the temperature of the heating tube 210 by using the temperature decrease key and the temperature increase key to adapt to different concentrations of depilatory wax. Moreover, for different models of wax applying head 400, the larger the discharge hole 410 is, the faster the corresponding discharging speed is. Therefore, it is necessary to adjust different gear positions by using the feed key, such that the pushing speed of the wax strip pushing device 300 can adapt to different models of wax applying head 400. According to the different waxes used in different parts, users can observe various parameters through the LED display screen and effectively select different temperatures for melting the wax and different pushing speeds, such that ordinary people can also effectively use the depilatory wax for hair removal, which can effectively reduce the professionalism required to use depilatory wax, making the hair removal with the depilatory wax a simple skill at home, without paying high care costs in beauty salons.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

Only several implementations of the present disclosure are illustrated in the above-mentioned embodiments, and the description thereof is relatively specific and detailed, but it should not be understood as a limitation on the scope of the present disclosure. It should be noted that for those of ordinary skill in the art, without departing from the concept of the present disclosure, several modifications and improvements can be made, which all fall within the protection scope of the present disclosure. Therefore, the protection scope of the present disclosure shall be subject to the appended claims.

What is claimed is:

1. A depilatory wax applying device, comprising:

a housing provided with a feed port and a discharge port;

a conveying channel provided in the housing, the conveying channel comprising a guiding tube, a heat insulation tube, and a heating tube that are connected successively, the guiding tube corresponding to the feed port, and the heating tube corresponding to the discharge port;

a wax strip pushing device provided between the feed port and the guiding tube and configured to push a wax strip into the guiding tube; and a control device provided in the housing and electrically connected to the heating tube and the wax strip pushing device, the control device comprising a circuit board and a battery, the heating tube and the wax strip pushing device being electrically connected to the circuit board, respectively, the battery supplies power to the heating tube, and powers the wax strip pushing device.

2. The depilatory wax applying device according to claim 1, further comprising a wax applying head provided at the discharge port, wherein one end of the heating tube extends out of the discharge port and is connected to the wax applying head, and the wax applying head has a flat discharge hole.

3. The depilatory wax applying device according to claim 2, wherein the wax applying head is made of metal, the wax applying head is covered with a silicone layer.

4. The depilatory wax applying device according to claim 2, wherein a sealing ring is provided between the wax applying head and the housing.

5. The depilatory wax applying device according to claim 1, wherein the housing is provided with a temperature decrease key, a temperature increase key, an LED display screen, a switch, a feed key, and a USB interface thereon, the temperature decrease key and the temperature increase key are configured to control a temperature of the heating tube, the feed key is configured to adjust a pushing speed of the wax strip pushing device by different gear positions, the LED display screen is configured to display a capacity of the battery, a temperature of the heating tube, and a current gear position of the wax strip pushing device, and the switch is configured to turn on/off the depilatory wax applying device.

6. The depilatory wax applying device according to claim 1, wherein the heating tube is provided with a first engaging member and a second engaging member, the housing is provided with an engaging groove matching the first engaging member to prevent the heating tube from moving, the housing is provided with a plurality of reinforcing ribs, and the reinforcing ribs form an engaging portion that matches the second engaging member to prevent the heating tube from rotating.

7. The depilatory wax applying device according to claim 1, wherein the wax strip pushing device comprises an electric motor, a driving wheel driven by the electric motor, and a driven wheel driven by the driving wheel, the driving wheel and the driven wheel are provided side by side, an axis of the driving wheel is parallel to an axis of the driven wheel, the driving wheel and the driven wheel are respectively provided with a recess along a circumferential direction thereof, an outer surface of each recess is provided with a plurality of convex ribs along the circumferential direction, a channel allowing the wax strip to pass through is formed between the two recesses, when the driving wheel drives the driven wheel to rotate, the plurality of convex ribs squeezes the wax strip from both sides and pushes the wax strip to move toward the guiding tube.

8. The depilatory wax applying device according to claim 7, wherein the driving wheel and the driven wheel each comprise a wheel body, an outer gear ring is provided at an end of the wheel body, the outer gear ring on the driving wheel is engaged with the outer gear ring on the driven wheel.

9. The depilatory wax applying device according to claim 8, wherein the wheel body of the driving wheel is fixedly sleeved on an output shaft of the electric motor, the wheel body of the driven wheel is rotatably mounted on a support shaft fixed on the housing.

10. The depilatory wax applying device according to claim 7, wherein at least three convex ribs are provided on the driving wheel or the driven wheel.

11. The depilatory wax applying device according to claim 1, wherein the wax strip pushing device comprises an electric motor and a first toggle gear, the first toggle gear is provided between the feed port and the guiding tube, and is located at one side of the wax strip, when the electric motor drives the first toggle gear to rotate, teeth of the first toggle gear are inserted into the wax strip and drive the wax strip to move toward the guiding tube.

12. The depilatory wax applying device according to claim 1, wherein the wax strip pushing device comprises an electric motor, a first toggle gear, and a second toggle gear, the second toggle gear is provided between the feed port and the guiding port, and is located at one side of the wax strip, the first toggle gear is engaged with the second toggle gear, and when the electric motor drives the first toggle gear or the second toggle gear to rotate, teeth of the second toggle gear are inserted into the wax strip and drive the wax strip to move toward the guiding tube.

13. The depilatory wax applying device according to claim 1, wherein the wax strip pushing device comprises a first electric motor, a second electric motor, a first worm, and a second worm, wherein the first worm, the second worm, and the wax strip are provided side by side, the wax strip is clamped between the first worm and the second worm; the first electric motor drives the first worm to rotate, the second electric motor drives the second worm to rotate, so as to drive the wax strip to move toward the guiding tube, wherein rotation directions of the first worm and the second worm are opposite.

14. The depilatory wax applying device according to claim 13, wherein the wax strip pushing device further comprises a first worm gear engaged with the first worm, and a second worm gear engaged with the second worm.

15. The depilatory wax applying device according to claim 1, wherein the housing is provided with a plurality of heat dissipation holes thereon corresponding to the heating tube, the plurality of heat dissipation holes comprise a first hole located at an outer surface of the housing, and a second hole located at an inner surface of the housing, baffles for blocking light are provided in the heat dissipation hole, and the baffles form a non-linear air passage between the first hole and the second hole.

16. A depilatory wax applying device, comprising:

a housing provided with a feed port and a discharge port;

a conveying channel provided in the housing, the conveying channel comprising a guiding tube, a heat insulation tube, and a heating tube that are connected successively, the guiding tube corresponding to the feed port, and the heating tube corresponding to the discharge port;

a wax strip pushing device provided between the feed port and the guiding tube and configured to push a wax strip into the guiding tube; and a control device provided in the housing and electrically connected to the heating tube and the wax strip pushing device, wherein the heating tube is provided with a first engaging member and a second engaging member, the housing is provided with an engaging groove matching the first engaging member to prevent the heating tube from moving, the housing is provided with a plurality of reinforcing ribs, and the reinforcing ribs form an engaging portion that matches the second engaging member to prevent the heating tube from rotating.

17. A depilatory wax applying device, comprising:

a housing provided with a feed port and a discharge port;

a conveying channel provided in the housing, the conveying channel comprising a guiding tube, a heat insulation tube, and a heating tube that are connected successively, the guiding tube corresponding to the feed port, and the heating tube corresponding to the discharge port;

a wax strip pushing device provided between the feed port and the guiding tube and configured to push a wax strip into the guiding tube; and a control device provided in the housing and electrically connected to the heating tube and the wax strip pushing device, wherein the wax strip pushing device comprises an electric motor and a first toggle gear, the first toggle gear is provided between the feed port and the guiding tube, and is located at one side of the wax strip, when the electric motor drives the first toggle gear to rotate, teeth of the first toggle gear are inserted into the wax strip and drive the wax strip to move toward the guiding tube.

* * * * *